US007699637B2

(12) United States Patent
Yeh

(10) Patent No.: US 7,699,637 B2
(45) Date of Patent: Apr. 20, 2010

(54) ELECTRICAL CONNECTOR HAVING SELF-ALIGNING PORTION FOR LEADING COVER

(75) Inventor: Cheng-Chi Yeh, Tu-cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/322,251

(22) Filed: Jan. 30, 2009

(65) Prior Publication Data

US 2009/0280666 A1 Nov. 12, 2009

(30) Foreign Application Priority Data

May 12, 2008 (TW) ..... 97208166 U

(51) Int. Cl.
*H01R 13/62* (2006.01)

(52) U.S. Cl. ..... 439/331; 439/73; 439/135

(58) Field of Classification Search ..... 439/331, 439/342, 135, 73
See application file for complete search history.

(56) References Cited

U.S. PATENT DOCUMENTS 6,676,429 B1 * 1/2004 McHugh et al. ..... 439/331
6,877,990 B2 4/2005 Liao et al.
7,059,885 B2 6/2006 Szu et al.
7,435,124 B2 * 10/2008 Ma et al. ..... 439/331
7,517,229 B2 * 4/2009 Ma ..... 439/73

* cited by examiner

*Primary Examiner*—Hae Moon Hyeon
(74) *Attorney, Agent, or Firm*—Andrew C. Cheng; Wei Te Chung; Ming Chieh Chang

(57) ABSTRACT

An LGA connector includes an insulative housing accommodating a plurality of terminals, a stiffener disposed around the insulative housing and a cover attached to the stiffener. The stiffener includes a front end, an opposite rear end, and two substantially vertical sidewalls connecting the front and rear ends. The cover is pivotally mounted to the rear end of the stiffener. The cover includes a pair of lateral sides having blocking walls being bent downwardly and distant to the sidewalls of the stiffener. One of the sidewall of the stiffener and the blocking wall of the cover has a self-aligning portion extending towards the other for leading the blocking wall to prevent the cover from inclining when the cover is rotated from an open position to a close position. Thus, the cover is shielded on the insulative housing safely without interfering with the insulative housing.

19 Claims, 9 Drawing Sheets

ELECTRICAL CONNECTOR HAVING SELF-ALIGNING PORTION FOR LEADING COVER

BACKGROUND OF THE INVENTION

1. Field of the Invention

The present invention relates to an electrical connector for electrically connecting an electronic package such as an integrated circuit (IC) package with a circuit substrate such as a printed circuit board (PCB), and particularly to a land grid array connector having self-aligning portions disposed between a cover and a stiffener for leading the cover to preventing the cover inclining.

2. Description of the Related Art

Land grid array (LGA) connector for electrically connecting a land grid package (LGP) with a printed circuit board (PCB) is widely used in the field of electrical connectors. The conventional LGA connector, such as these disclosed in U.S. Pat. Nos. 6,877,990 and 7,059,885, issued to Liao on Apr. 12, 2005, and Szu on Jun. 13, 2006, respectively, typically comprises an insulative housing, a stiffener mounted around the insulative housing, a cover pivotally engaged with one end of the stiffener, and a lever engaged with the other end of the stiffener for fastening the cover onto the insulative housing. The LGP is sandwiched between the cover and the insulative housing. The insulative housing usually defines an opening adapted for receiving the LGP and cutouts in two transversal sides thereof, respectively, for removing the LGP much easily.

In use, the cover is firstly rotated to a vertical open position, and the LGP (not shown) is seated into the opening of the insulative housing. Then the cover is rotated to a horizontal close position and locked by the lever. At last, the LGP (not shown) is sandwiched between the insulative housing and the cover.

However, in the above-mentioned LGA connector, there is much space between the cover and the stiffener to mount and rotate the cover easily. In this case, when the cover is rotated to the close position, the cover may incline, and sidewalls of the cover will interfere with the stiffener or the insulative housing. As a result, the insulative housing is damaged and the cover is difficult to close.

In view of the above, a new LGA connector which overcomes the above-mentioned disadvantages is desired.

SUMMARY OF THE INVENTION

Accordingly, an object of the present invention is to provide an LGA connector with self-aligning portions disposed between a cover and a stiffener for leading the cover and preventing the cover from inclining.

To achieve the above-mentioned object, an LGA connector in accordance with the present invention, for interconnecting an electronic package and a circuit substrate, comprises an insulative housing, a plurality of terminals received in the insulative housing, a stiffener disposed around the insulative housing and a cover attached to the stiffener. The stiffener includes a front end, an opposite rear end, and two substantially vertical sidewalls connecting the front and rear ends. The cover is pivotally mounted to the rear end of the stiffener for pressing against the electronic package which is seated upon the housing and electrically engaged with the terminals. The cover includes a pair of lateral sides with blocking walls being bent downwardly and distant to the sidewalls of the stiffener. One of the sidewall of the stiffener and corresponding blocking wall of the cover has a self-aligning portion extending towards the other and leading the blocking wall to prevent the cover from inclining when the cover is rotated from an open position to a close position relative to the stiffener.

Other objects, advantages and novel features of the invention will become more apparent from the following detailed description when taken in conjunction with the accompanying drawings, in which:

DETAILED DESCRIPTION OF EMBODIMENTS OF THE INVENTION

Figure 1:
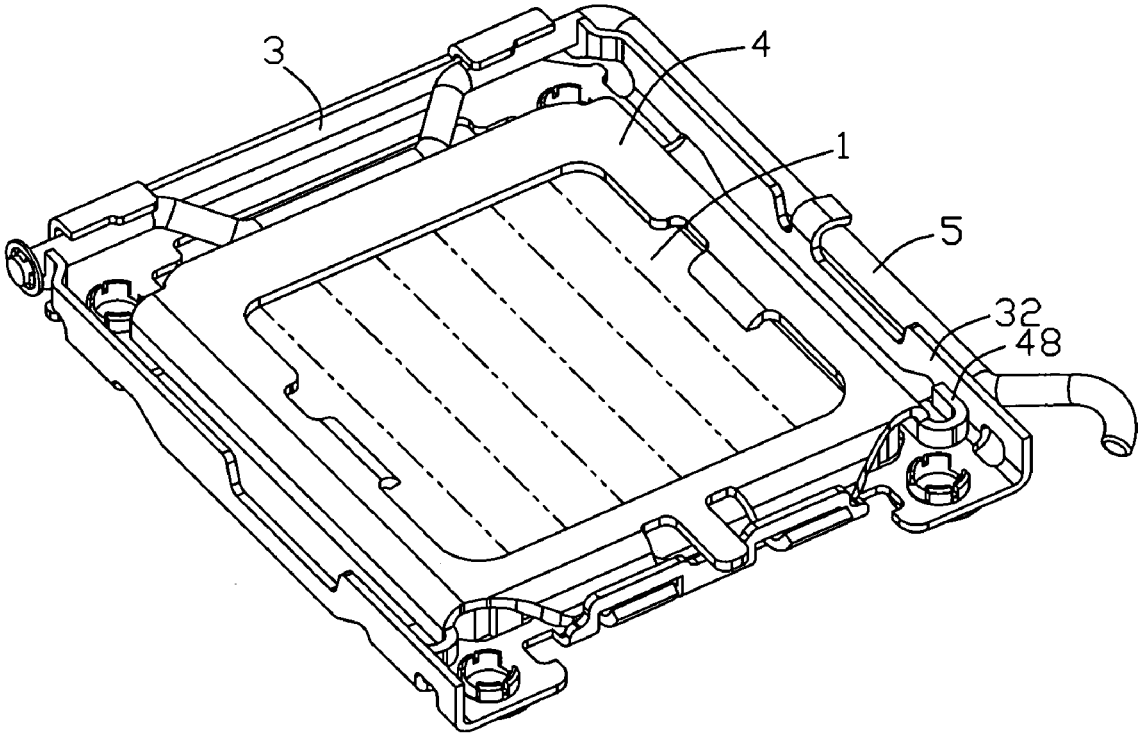
FIG. 1 is an assembled, perspective view of an LGA connector in accordance with a first embodiment of the present invention, wherein a cover of the LGA connector is in a close position.
Figure 2:
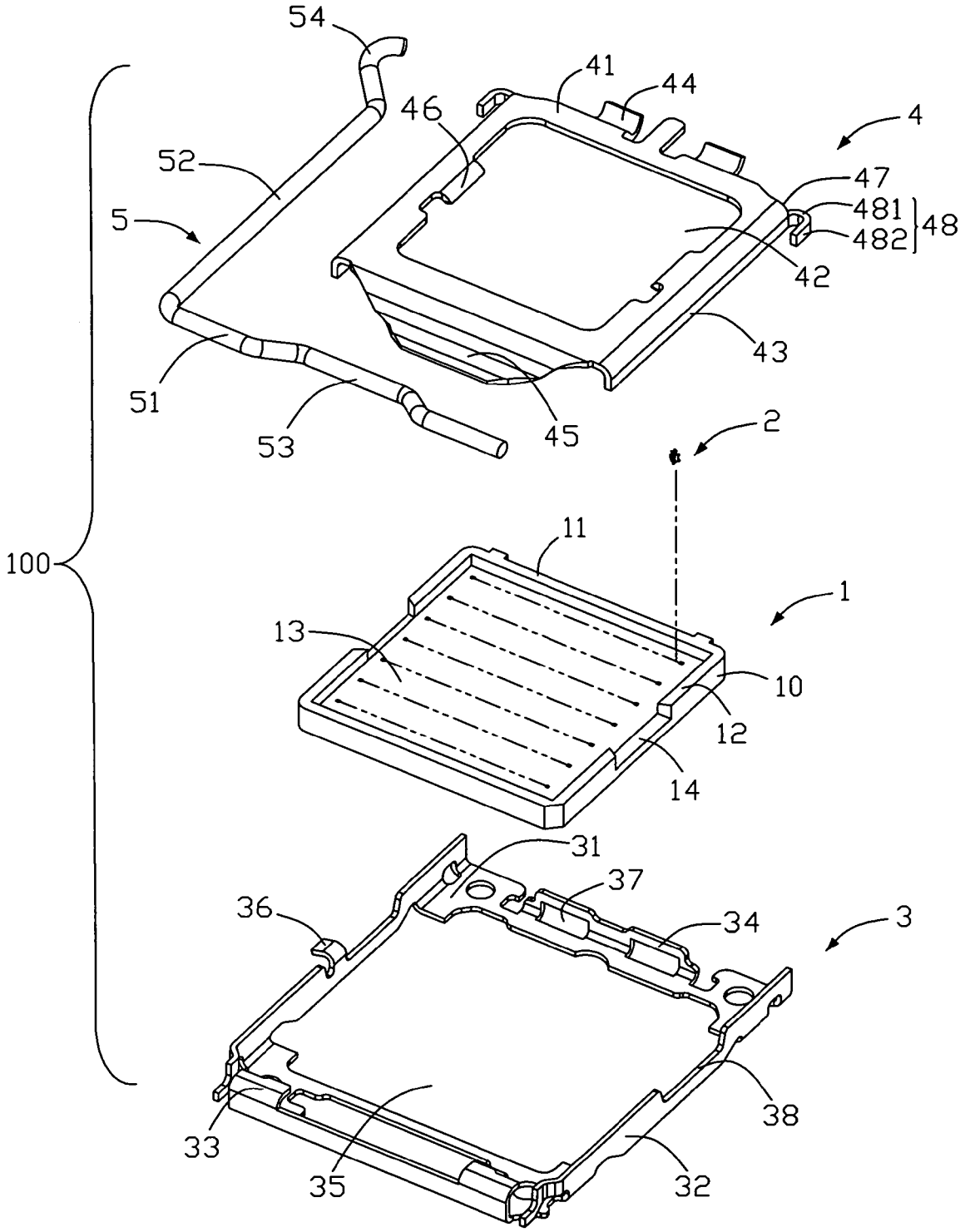
FIG. 2 is an exploded, perspective view of the LGA connector shown in FIG. 1.

Reference will now be made to the drawings to describe the present invention in detail.

Referring to FIGS. 1-4, an LGA connector 100 in accordance with the first embodiment of the present invention comprises an insulative housing 1, a plurality of terminals 2 received in the insulative housing 1, a stiffener 3 surrounding the insulative housing 1, a cover 4 and a load lever 5 pivotally assembled to two opposite ends of the stiffener 3, respectively.

The insulative housing 1 has a substantially rectangular configuration. The insulative housing 1 includes a base 10 defining a top face (not labeled) and an opposite bottom face (not labeled) and two pairs of opposite peripheral walls 11, 12 extending upwardly from the base 10. The pair of the opposite peripheral walls 11 are disposed along a horizontal direction of the insulative housing 1. The base 10 and the walls 11, 12 commonly define a receiving cavity 13 for accommodating an LGP (not shown). The base 10 defines a plurality of passageways (not shown) therethrough adapted for receiving the plurality of terminals 2. The pair of longitudinal walls 12 each defines a first cutout 14 in a centre thereof for removing the LGP (not shown) friendly. The first cutout 14 laterally runs through the longitudinal wall 12.

The stiffener 3 comprises a bottom plate 31, two opposite substantially vertical sidewalls 32 extending upwardly from the bottom plate 31, a front end 33 and an opposite rear end 34 connecting the two sidewalls 32 to commonly form a window 35 for receiving the insulative housing 1. A hooking portion 36 extends outwardly from a top end of one sidewall 32 for retaining the load lever 5. The two sidewalls 32 are parallel and adjacent to the longitudinal walls 12 of the insulative housing 1, respectively, and each defines a second cutout 38 corresponding to the first cutout 14 of the longitudinal wall 12 of the insulative housing 1. The second cutouts 38 run through top edges of the sidewalls 32 respectively. The rear end 34 defines two locking holes 37 for retaining the cover 4.

The cover 4 is pivotally engaged with the rear end 34 of the stiffener 3 and also has a substantially rectangular configuration and comprises a main body 41 defining an opening 42 and two opposite blocking walls 43 bent downwardly from two lateral edges of the main body 41, respectively. A pair of latches 44 extend from one end of the main body 41 for engaging with the locking holes 37 of the stiffener 3, and a tongue portion 45 extends from the other end of the main body 41 for being pressed by the lever 5. A pair of pressing portions 46 bends toward the insulative housing 1 from inner sides of the main body 41 for pressing the LGP (not shown) which is seated into the cavity 13 of the insulative housing 1. Each blocking wall 43 has a rear edge 47, and a self-aligning portion 48. The self-aligning portion 48 defines a J-like cross-section. The J-like cross-section is lying horizontally when the cover 4 is located in a final horizontal locked position. The self-aligning portion 48 includes a curved section 481 extending from the rear edge 47 of the blocking wall 43 and a leading section 482 extending from the curved section 481 and substantially parallel to the sidewall 32 of the stiffener 3.

The lever 5 is pivotally engaged with the front end 33 of the stiffener 3 and includes a pivotal arm 51 and an operational arm 52 substantially perpendicular to the pivotal arm 51. The pivotal arm 51 has a middle offset tab 53 for pressing on the tongue portion 45 of the cover 4, and the operational arm 52 has a curved handle 54 extending outwardly.

Figure 3:
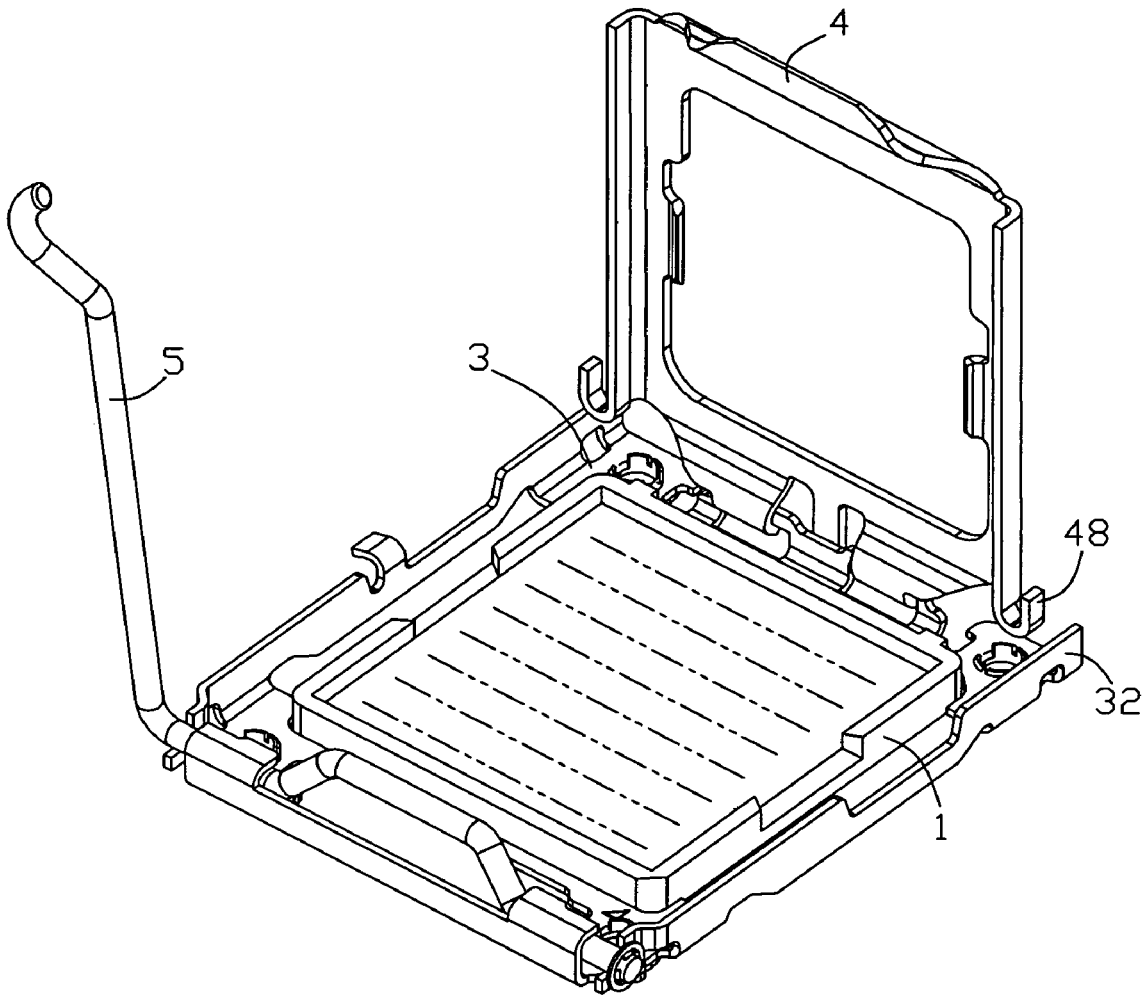
FIG. 3 is an assembled, perspective view of the LGA connector shown in FIG. 1, wherein the cover of the LGA connector is in an open position.
Figure 4:
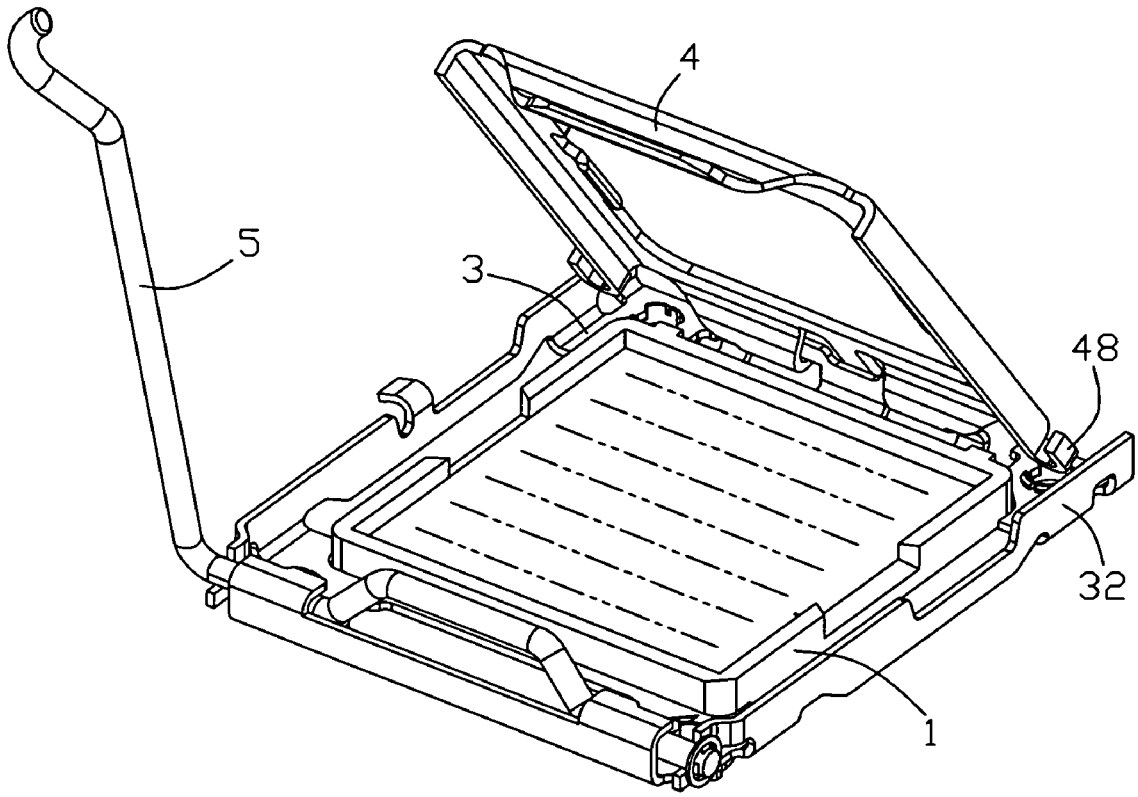
FIG. 4 is an assembled, perspective view of the LGA connector shown in FIG. 1, showing the cover in another position.

Turning now to FIGS. 1, 3 and 4, in using, when the LGA connector 100 is assembled, the cover 4 can be rotated between an open position and a close position. In the open position, the cover 4 is substantially perpendicular to the stiffener 3 with the self-aligning portion 48 of the cover 4 higher than the sidewalls 32 of the stiffener 3, and the LGP (not shown) is seated into the cavity 13 of the insulative housing 1. Then the cover 4 is rotated from the open position to the close position, the self-aligning portion 48 of the cover 4 is leaded by the sidewall 32 of the stiffener 3 so as to prevent the cover 4 from inclining. As a result, the cover 4 is closed without interfering with the insulative housing 1 and safely covers upon a top surface of LGP (not shown). At last, the lever 5 is rotated until the operational arm 52 is locked by the hooking portion 36 of the stiffener 3, therefore to fasten the LPG (not shown) between the insulative housing 1 and the cover 4.

Figure 5:
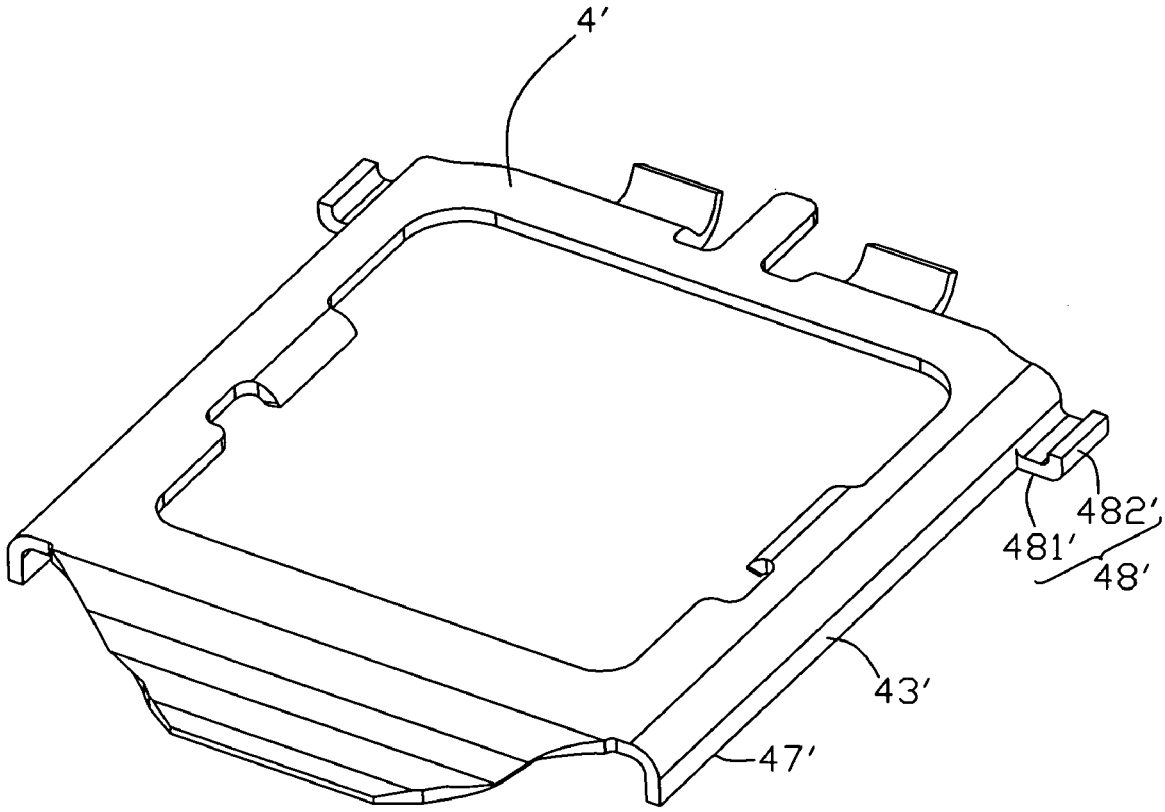
FIG. 5 is a perspective view of an alternative cover of the LGA connector shown in FIG. 1.

FIG. 5 relates to an alternative cover 4' of the LGA connector in accordance with the first embodiment of the present invention. Similar to the first embodiment, a self-aligning portion 48' is disposed on a rear end of each blocking wall 43' of the cover 4'. Differently, the self-aligning portion 48' includes a flat section 481' extending horizontally from a bottom edge 47' of the blocking wall 43' and a leading section 482' substantially perpendicular to the flat section 481' and adjacent to the corresponding sidewall 32 of the stiffener 3. When the cover 4' is rotated from an open position to the final horizontal locked position, the leading section 482' engages with corresponding interior surface of the sidewall 32 of the stiffener 3, so that the self-aligning portion 48' is leaded by the sidewall 32 to prevent the cover 4' from inclining.

Figure 6:
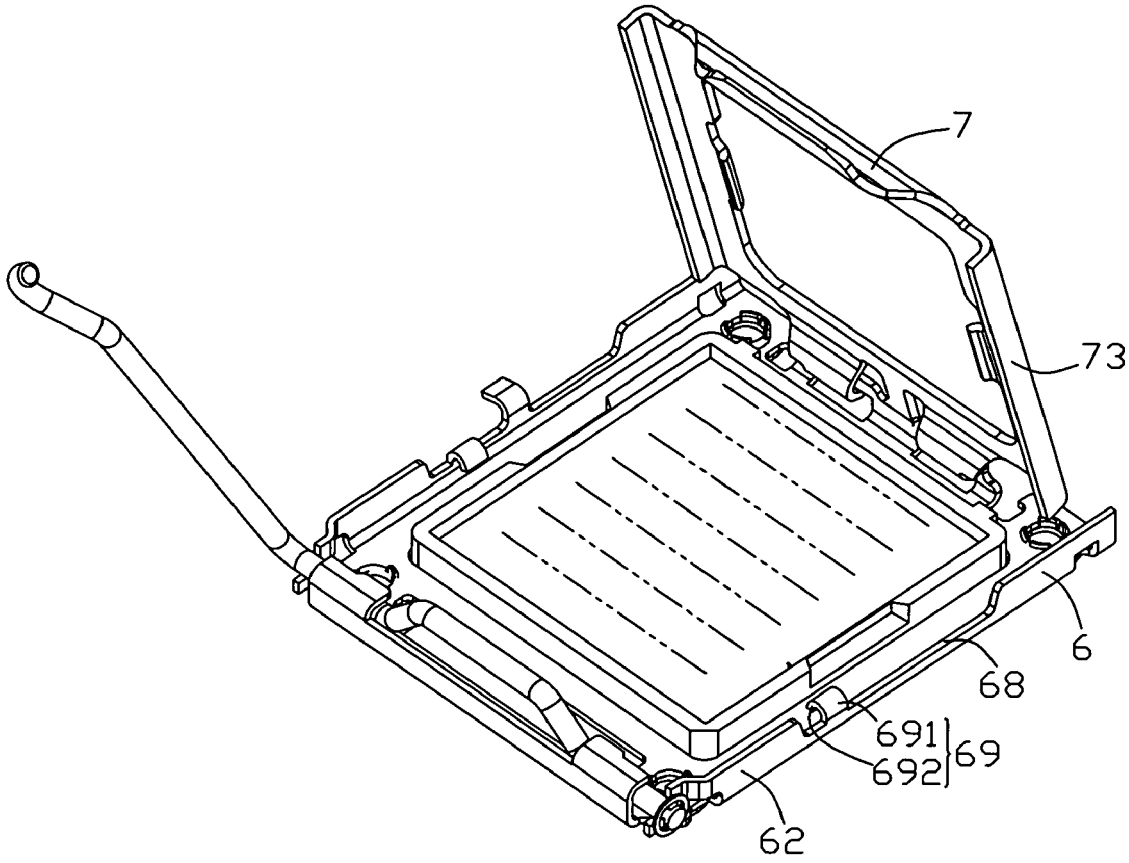
FIG. 6 is an assembled, perspective view of an LGA connector in accordance with a second embodiment of the present invention, wherein a cover of the LGA connector is in an open position.
Figure 7:
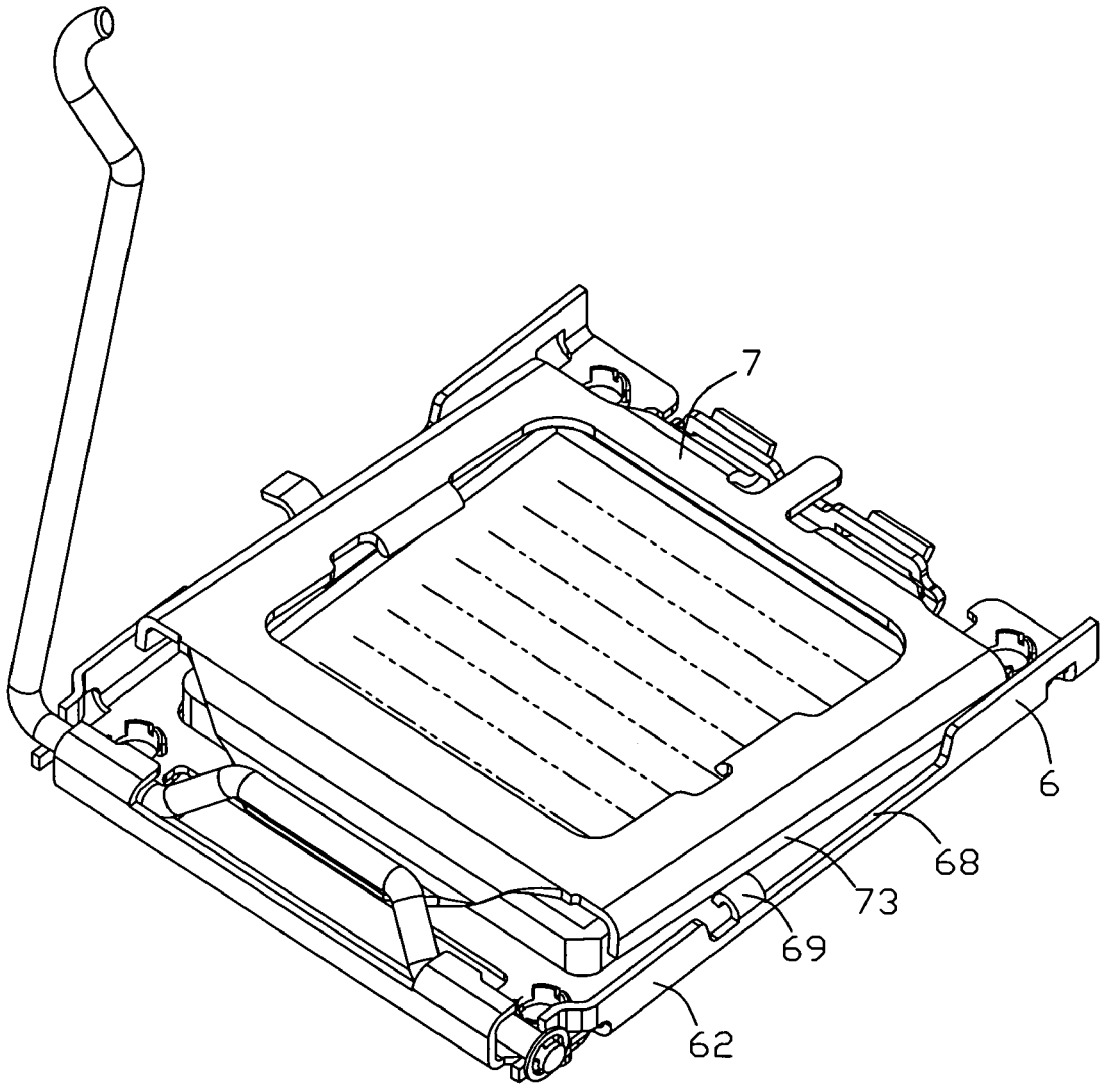
FIG. 7 is an assembled, perspective view of the LGA connector shown in FIG. 6, showing the cover in another position.

FIGS. 6 and 7 relates to an LGA connector in accordance with a second embodiment of the present invention. Different to the first embodiments, a self-aligning portion 69 is disposed on a sidewall 62 of a stiffener 6. The self-aligning portion 69 unitarily extends from the sidewall 62 toward a cover 7. The sidewall 62 has a third cutout 68. The self-aligning portion 69 includes an arced section 691 extending upwardly and inwardly from a bottom edge of the cutout 68 of the sidewall 62 and a leading section 692 extending downwardly from the arced section 691 and adjacent to a blocking wall 73 of the cover 7. The self-aligning portion 69 also defines a J-like cross-section. The J-like cross-section is upside down standing vertical when the cover 7 is located in the final horizontal locked position. When the cover 7 is rotated from the open position to the locked position, the leading section 692 of the self-aligning portion 69 engages with corresponding exterior surface of the blocking wall 73 of the cover 7, so that the cover 7 is leaded by the self-aligning portion 69 of the stiffener 6 to prevent the cover 7 from inclining.

Figure 8:
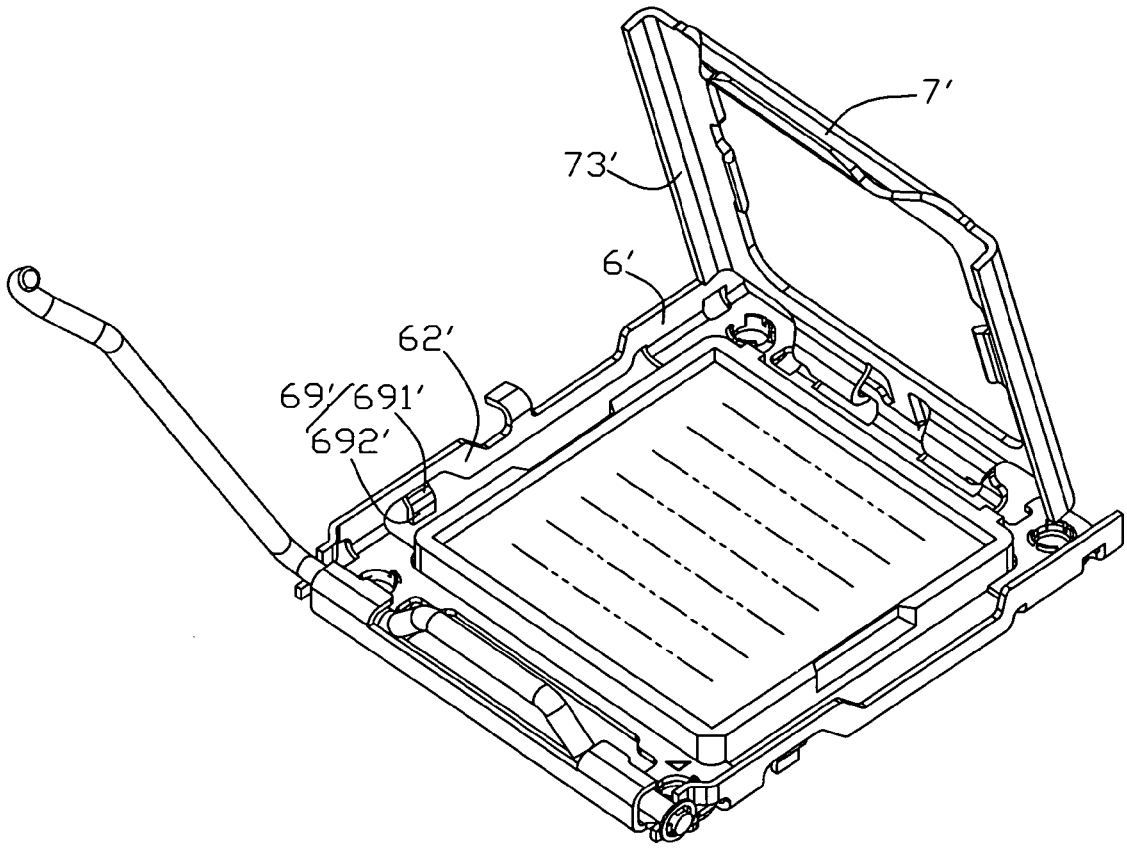
FIG. 8 is an assembled, perspective view of an LGA connector in accordance with a third embodiment of the present invention, showing a cover of the LGA connector in an open position.
Figure 9:
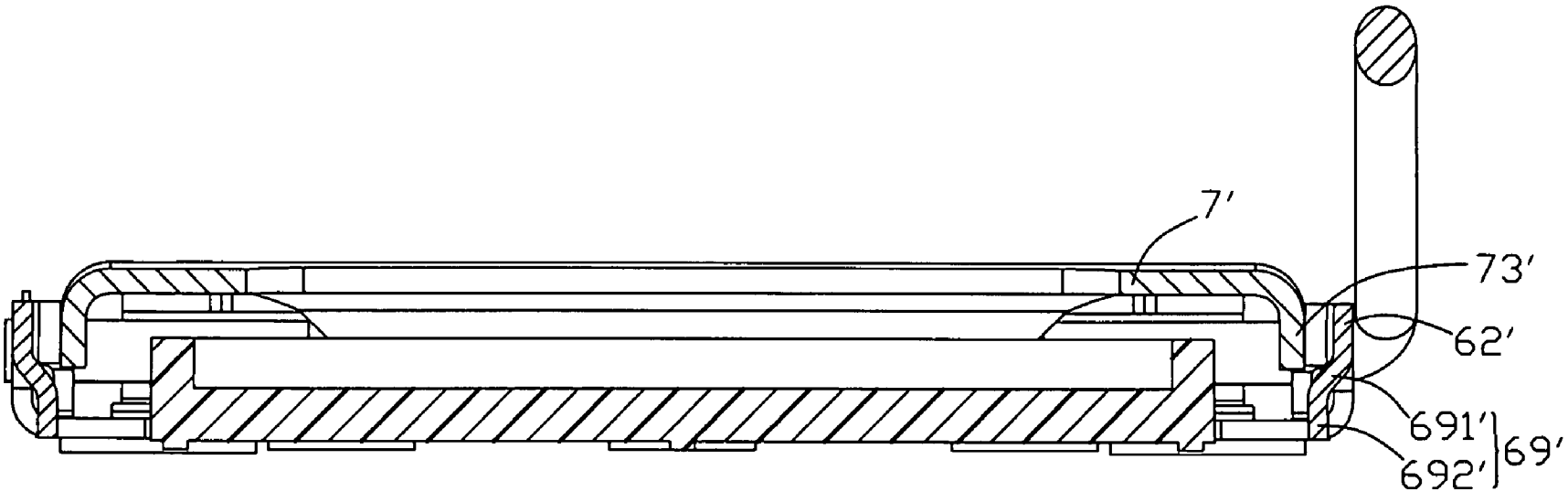
FIG. 9 is a cross-section view of the LGA connector shown in FIG. 8, wherein the cover is in a close position.

FIGS. 8 and 9 relates to an LGA connector in accordance with a third embodiment of the present invention. The third embodiment is similar to the second embodiment except a position of a self-aligning portion 69' on a sidewall 62' of a stiffener 6'. The self-aligning portion 69' includes an oblique section 691' extending inwardly and downwardly from a bottom edge of the sidewall 62' and a leading section 692' extending downwardly from the oblique section 691' and adjacent to a blocking wall 73' of a cover 7'. When the cover 7' is rotated from an open position to a close position, the leading section 692' of the self-aligning portion 69' engages with corresponding exterior surface of the blocking wall 73' of the cover 7', so that the cover 7' is leaded by the self-aligning portion 69' of the stiffener 6' to prevent the cover 7' from inclining.

While preferred embodiment in accordance with the present invention has been shown and described, equivalent modifications and changes known to persons skilled in the art according to the spirit of the present invention are considered within the scope of the present invention as defined in the appended claims.

What is claimed is:

1. An electrical connector, for interconnecting an electronic package and a circuit substrate, comprising:

an insulative housing;

a plurality of terminals received in the insulative housing;

a stiffener disposed around the insulative housing, said stiffener comprising a front end, an opposite rear end, and two substantially vertical sidewalls connecting the front and rear ends;

a cover pivotally mounted to the rear end of the stiffener for pressing against the electronic package which is seated upon the housing and electrically engaged with the terminals, said cover including a pair of lateral sides with blocking walls being bent downwardly and distant to the sidewalls of the stiffener; wherein one of the sidewall of the stiffener and corresponding blocking wall of the cover has a self-aligning portion extending towards the other and leading the blocking wall to prevent the cover from inclining when the cover is rotated from a open position to a close position relative to the stiffener.

2. The electrical connector as claimed in claim 1, wherein the self-aligning portion is disposed on the blocking wall of the cover, said self-aligning portion includes a curved section extending from a rear edge of the blocking wall and a leading section forwardly extending from the curved section and adjacent to the sidewall of the stiffener.

3. The electrical connector as claimed in claim 1, wherein the self-aligning portion is disposed on the blocking wall of the cover, said self-aligning portion includes a flat section extending from a bottom edge of the blocking wall and a leading section substantially perpendicular to the flat section and adjacent to the sidewall of the stiffener.

4. The electrical connector as claimed in claim 1, wherein the self-aligning portion is disposed on the sidewall of the stiffener, said self-aligning portion includes an arced section extending upwardly from a bottom edge of a cutout defined on the sidewall and a leading section extending downwardly from the arced section and being adjacent to the blocking wall of the cover.

5. The electrical connector as claimed in claim 1, wherein the self-aligning portion is disposed on the sidewall of the stiffener, said self-aligning portion includes an oblique section extending inwardly and downwardly from a bottom edge of the sidewall and a leading section extending downwardly from the oblique section and being adjacent to the blocking wall of the cover.

6. The electrical connector as claimed in claim 1, further comprises a load lever pivotally engaged on the front end of the stiffener for fastening the cover.

7. The electrical connector as claimed in claim 1, wherein said blocking wall is bent downwardly.

8. A fastening device, for securing an electronic package to an insulative housing, comprising:

a stiffener comprising a front end, an opposite rear end, and two substantially vertical sidewalls connecting the front and rear ends, said two ends and two sidewalls commonly defining an opening for receiving the insulative housing;

a cover pivotally mounted to the rear end of the stiffener for pressing against the electronic package which is seated upon the insulative housing, said cover including a pair of lateral sides having blocking walls bent downwardly and parallel to the sidewalls of the stiffener, the cover defining an open position to allow the electronic package to be downwardly seated upon the insulative housing, and a close position where each blocking wall is located between the insulative housing and the sidewall of the stiffener;

a lever pivotally mounted to the other end of the stiffener; wherein at least one self-aligning portion is disposed between the sidewall of the stiffener and corresponding blocking wall of the cover, and the self-aligning portion leads the blocking wall of the cover to prevent the cover from inclining when the cover is rotated from the open position to the close position.

9. The fastening device as claimed in claim 8, wherein the self-aligning portion is disposed on the blocking wall of the cover, said self-aligning portion includes a curved section extending from a rear edge of the blocking wall and a leading section forwardly extending from the curved section and adjacent to the sidewall of the stiffener.

10. The fastening device as claimed in claim 8, wherein the self-aligning portion is disposed on the blocking wall of the cover, said self-aligning portion includes a flat section extending from a bottom edge of the blocking wall and a leading section substantially perpendicular to the flat section and adjacent to the sidewall of the stiffener.

11. The fastening device as claimed in claim 8, wherein the self-aligning portion is disposed on the sidewall of the stiffener, said self-aligning portion includes an arced section extending upwardly from a bottom edge of a cutout defined on the sidewall and a leading section extending downwardly from the arced section and adjacent to the blocking wall of the cover.

12. The fastening device as claimed in claim 8, wherein the self-aligning portion is disposed on the sidewall of the stiffener, said self-aligning portion includes an oblique section extending inwardly and downwardly from a bottom edge of the sidewall and a leading section extending downwardly from the oblique section and being adjacent to the blocking wall of the cover.

13. An electrical connector assembly comprising:

an insulative housing having a receiving cavity in a top face thereof and defining a pair of opposite peripheral walls along a horizontal direction;

a plurality of contacts disposed in the housing;

a stiffener located around the insulative housing;

a loosely cover pivotally mounted around one end of the stiffener and defining a free end disposed around one of the peripheral walls of the insulative housing when said cover is located in a final horizontal locked position;

a load lever pivotally mounted around the other end of the stiffener for locking the free end of the cover; and a pair of side walls of said the stiffener respectively located by two sides of the housing and between the pair of opposite peripheral walls; wherein at least a pair of self-aligning devices formed between the cover and the corresponding pair of the side walls of the stiffener to bias the cover to be positioned in a middle true position during downward rotation of the cover so that said cover is not tilted till reaching the final horizontal locked position.

14. The electrical connector as claimed in claim 13, wherein said self-aligning device unitarily extends from the cover toward the corresponding side wall.

15. The electrical connector as claimed in claim 13, wherein said self-aligning device unitarily extending from the side wall of the stiffener toward the cover.

16. The electrical connector as claimed in claim 13, wherein said self-aligning device is located closer to one of the opposite peripheral walls or therebetween.

17. The electrical connector as claimed in claim 13, wherein said cover includes a pair of blocking walls on two sides closer to the corresponding pair of said walls, respectively, when said cover is located in the final locked position.

18. The electrical connector as claimed in claim 13, wherein said self-aligning device defines a J-like cross-section.

19. The electrical connector as claimed in claim 18, wherein said J-like cross-section is lying horizontally when said self-aligning device is unitarily formed with the cover around the first end and the cover is located in the final horizontal locked position, while said J-like cross-section is upside down standing vertically when said self-aligning device is unitarily formed with the corresponding side wall.

* * * * *